US007604478B2

(12) United States Patent
Anderson et al.

(10) Patent No.: US 7,604,478 B2
(45) Date of Patent: Oct. 20, 2009

(54) VAPOR RESISTANT FUEL BURNING APPLIANCE

(75) Inventors: Peter M. Anderson, Minneapolis, MN (US); Robert M. Ruhland, Shakopee, MN (US)

(73) Assignee: Honeywell International Inc., Morristown, NJ (US)

( * ) Notice: Subject to any disclaimer, the term of this patent is extended or adjusted under 35 U.S.C. 154(b) by 422 days.

(21) Appl. No.: 10/907,117

(22) Filed: Mar. 21, 2005

(65) Prior Publication Data

US 2006/0210937 A1 Sep. 21, 2006

(51) Int. Cl.
*F23N 1/24* (2006.01)

(52) U.S. Cl. ..... 431/22; 431/6; 431/18; 340/632; 122/14.21

(58) Field of Classification Search ..... 431/6, 431/15, 16, 18, 22; 340/632, 634, 633, 587, 340/529, 530; 122/13.1, 14.21; 73/23.2
See application file for complete search history.

(56) References Cited

U.S. PATENT DOCUMENTS 3,045,198 A 7/1962 Dolan et al.
3,399,398 A * 8/1968 Becker et al. ..... 340/507
3,489,912 A * 1/1970 Hoffman, Jr. ..... 307/9.1
3,717,858 A * 2/1973 Hadden ..... 340/870.2
3,789,231 A * 1/1974 Hayden ..... 307/9.1
3,886,535 A * 5/1975 Cirincione ..... 123/143 R
3,906,473 A * 9/1975 Le Vine ..... 340/634
3,955,186 A * 5/1976 Washburn et al. ..... 137/78.4
3,980,997 A * 9/1976 Berns et al. ..... 340/630
4,037,578 A * 7/1977 Dersch et al. ..... 123/179.3
4,086,574 A * 4/1978 Miyabe ..... 340/529
4,129,030 A 12/1978 Dolan
4,134,112 A * 1/1979 Kercheval et al. ..... 340/632
4,185,491 A * 1/1980 Owen ..... 73/31.06
4,219,806 A * 8/1980 Enemark ..... 340/632
4,223,692 A * 9/1980 Perry ..... 137/78.4
4,250,829 A * 2/1981 Stephens, Jr. ..... 440/1
4,270,041 A * 5/1981 Pleyber ..... 377/19
4,334,258 A * 6/1982 Seeman et al. ..... 361/170
4,388,822 A * 6/1983 Heller ..... 73/31.02
4,422,073 A * 12/1983 Winner ..... 340/870.21
4,446,718 A * 5/1984 Bukowiecki et al. ..... 73/31.06

(Continued)

FOREIGN PATENT DOCUMENTS

FR 2 633 760 * 1/1990

(Continued)

OTHER PUBLICATIONS http://www.contractormag.com/articles/newsarticle.cfm?newsid=89, CONTRACTORmag.com, "Water Heater Double Whammy," 4 pages, printed Mar. 17, 2004.

*Primary Examiner*—Carl D Price

(57) ABSTRACT

A method and apparatus for controlling a fuel-fired appliance is provided. The appliance enters a wait state in which burner operation ceases if a sensor indicates the presence of flammable vapors that are above an acceptable and/or safe vapor level. The appliance returns to a run state if the vapor level returns to an acceptable and/or safe vapor level within a period of time, but enters a lockout state if the vapor level does not return to an acceptable and/or safe vapor level within the period of time.

24 Claims, 9 Drawing Sheets

U.S. PATENT DOCUMENTS 4,638,789 A * 1/1987 Ueki et al. ..... 122/14.21
4,663,958 A 5/1987 Matthiessen
4,910,463 A * 3/1990 Williams et al. ..... 324/468
4,914,313 A * 4/1990 Clingon et al. ..... 307/10.1
4,925,386 A 5/1990 Donnelly et al.
4,944,241 A * 7/1990 Carter ..... 114/211
5,069,154 A * 12/1991 Carter ..... 114/211
5,165,883 A * 11/1992 Van Bemmel ..... 431/6
5,184,500 A * 2/1993 Krcma et al. ..... 73/23.2
5,276,434 A * 1/1994 Brooks et al. ..... 340/632
5,315,539 A 5/1994 Hawes
5,364,260 A 11/1994 Moore
5,540,273 A * 7/1996 Polk et al. ..... 165/11.1
5,575,274 A * 11/1996 DePalma ..... 126/512
5,592,147 A * 1/1997 Wong ..... 340/522
5,608,384 A * 3/1997 Tikijian ..... 340/632
5,682,145 A * 10/1997 Sweetman et al. ..... 340/632
5,797,358 A 8/1998 Brandt et al.
5,807,098 A * 9/1998 Deng ..... 432/36
5,969,623 A 10/1999 Fleury et al.
6,003,477 A 12/1999 Valcic
6,138,613 A * 10/2000 Bourke et al. ..... 122/13.01
6,139,311 A 10/2000 Bowman et al.
6,196,164 B1 3/2001 Valcic
6,295,952 B1 10/2001 Reynolds et al.
6,390,028 B1 5/2002 Langmead et al.
RE37,745 E * 6/2002 Brandt et al. ..... 122/14.2
6,412,447 B1 7/2002 Trant et al.
6,418,883 B2 7/2002 Bourke et al.
6,554,608 B1 4/2003 Bowman et al.
6,622,661 B1 9/2003 Hotton
6,626,133 B2 * 9/2003 Schell et al. ..... 122/504
6,661,346 B1 * 12/2003 Wood et al. ..... 340/601
6,662,757 B2 12/2003 Lesage
6,722,876 B2 4/2004 Abraham et al.
6,814,031 B2 11/2004 Stretch et al.
6,877,462 B2 4/2005 Adams et al.
6,883,366 B1 4/2005 Gehman et al.
6,908,300 B1 6/2005 Donnelly
6,916,664 B2 7/2005 Bonne et al.
6,973,819 B2 * 12/2005 Ruhland et al. ..... 73/23.31
7,032,542 B2 4/2006 Donnelly et al.
7,083,408 B1 8/2006 Donnelly
7,112,059 B2 9/2006 Donnelly
7,159,540 B2 1/2007 Garrabrant et al.
7,242,309 B2 * 7/2007 Yokosawa et al. ..... 340/632
2001/0038986 A1 11/2001 Abraham et al.
2001/0042564 A1 11/2001 Abraham et al.
2002/0134322 A1 9/2002 Dolan
2003/0020619 A1 * 1/2003 Winters et al. ..... 340/632
2003/0235925 A1 12/2003 Bonne et al.
2005/0092066 A1 5/2005 Ruhland et al.
2005/0202358 A1 9/2005 Donnelly
2006/0150926 A1 7/2006 Donnelly
2007/0215066 A1 9/2007 Garrabrant
2007/0215067 A1 9/2007 Garrabrant

FOREIGN PATENT DOCUMENTS

JP 2001-14573 * 1/2001
JP 2004-240941 * 8/2004

* cited by examiner

VAPOR RESISTANT FUEL BURNING APPLIANCE

TECHNICAL FIELD

The present invention relates generally to fuel burning appliances and relates more particularly to fuel burning appliances that help resist igniting external flammable vapors.

BACKGROUND

Fuel-fired, storage-type water heaters often include a combustion chamber and air plenum disposed below a water tank. A burner element, fuel manifold tube, ignition source, thermocouple, and a pilot tube typically extend into the combustion chamber. When the temperature of the water in the tank falls below a set minimum, fuel is introduced into the combustion chamber through the fuel manifold tube and burner element. This fuel is ignited by the pilot flame or other ignition source, and the flame is maintained around the burner element. Air is drawn into the plenum, sometimes assisted by a blower, and the air mixes with the fuel to support combustion within the combustion chamber. The products of combustion typically flow through a flue or heat exchange tube in the water tank to heat the water by convection and conduction.

In some cases, a water heater may be positioned in an area that is also occupied by lawnmowers, chain saws, snow blowers, trimmers, paint, and/or other equipment and/or chemicals. In such cases, it is not uncommon for gasoline and/or other flammable substances (e.g., kerosene, diesel, turpentine, solvents, alcohol, propane, methane, butane, etc.) to be present in the same area. Such flammable substances can emit flammable vapors.

If the flammable substances are mishandled, the flammable vapors may encounter an ignition source, such as the pilot flame or burner flame of a fuel-fired water heater. As a result of the mishandling of flammable substances, the flammable vapors may ignite, and the flame may follow the flammable vapors to their source, causing an explosion and/or a fire. Consequently, various attempts have been made at producing water heaters and other fuel fired appliances that are less prone to igniting flammable vapors. A need remains, however, for appliances such as water heaters that are more immune to external flammable vapors. A need also remains for appliances such as water heaters that are more immune to igniting external flammable vapors while resisting unnecessary lockouts.

SUMMARY

The present invention pertains generally to appliances that include a burner such as a fuel-fired burner and to methods of controlling such appliances. In one illustrative embodiment, a method is provided to help resist igniting external flammable vapors in a fuel burning appliance. The appliance may include a burner and a sensor that can detect flammable vapors exterior to the burner. In the illustrative method, the appliance enters a wait state if flammable vapors are detected at an unsafe level or a level approaching unsafe. An unsafe level of flammable vapors can include a vapor concentration that is at risk for burning or exploding. During the wait state, the burner (and pilot flame and ignition source, if so equipped) is not permitted to operate. The wait state can extend for a predetermined amount of time such as thirty seconds, one minute, five minutes, ten minutes, thirty minutes or any other suitable time period.

If no substantial flammable vapor is detected at the end of the wait state, the appliance may return to a run state in which the burner is permitted to operate. Conversely, if sufficient flammable vapors are still present at the end of the wait state, the appliance enters a lockout state. In some embodiments, the lockout state prevents burner operation and can require user intervention to override the lockout state.

In some embodiments, an output of the flammable vapor sensor is monitored, at least periodically. The wait state is initiated if the sensor output exceeds a first or upper vapor limit. The appliance is permitted to operate as long as the sensor output is below the first or upper vapor limit. Once in the wait state, the sensor output may continue to be monitored. At the end of the wait state, the appliance can be restarted if the sensor output is below a second or lower vapor limit. However, if the sensor output is not below the second or lower vapor limit at the end of the wait state, the appliance may enter a lockout state, which in some cases, may require user intervention to override. In some cases, the second or lower vapor limit may be the same or lower than the first or upper vapor limit.

In another illustrative embodiment, the output of a vapor sensor can be monitored. A counter may be incremented if the sensor output indicates the presence of sufficient flammable vapors, while the counter may be decremented if the sensor output indicates the absence of sufficient flammable vapors.

A wait state in which burner is not permitted to operate can be initiated when the counter reaches a first predetermined value, which in some cases, can represent a vapor concentration that is lower than the explosive limit for the particular flammable vapors being detected by the sensor. When entering the wait state, the counter can be artificially incrementing further in order to provide a delay or safety margin, if desired.

During the wait state, the sensor output can be monitored. The counter can be incremented if the sensor output indicates a sufficient presence of flammable vapors. Likewise, the counter may be decremented if the sensor output indicates insufficient flammable vapors. At the end of the wait state, the wait state can be terminated and thus the appliance can be restarted if the counter is below a second predetermined value. If the counter is at or above the second predetermined value, the appliance can enter a lockout state. In some cases, the second predetermined level may be the same, lower or higher than the first predetermined level, as desired.

Yet another illustrative embodiment of the present invention can include a fuel-fired water heater or other fuel-fired appliance. In one example, the water heater may have a burner, a sensor that is adapted to detect flammable vapors that are exterior to the burner, and a controller. The controller may be adapted to monitor the sensor output and to stop operation of the burner if the sensor output indicates the presence of a predetermined amount or concentration of flammable vapors. The controller may also be adapted to restart the burner if the sensor output subsequently indicates a substantial lack of flammable vapors.

The controller may be further adapted to lockout the burner if the sensor output subsequently indicates the presence of a predetermined amount or concentration of flammable vapors. The controller may be adapted to regulate fuel flow to the burner, the pilot light (if the water heater is so-equipped) or to both. In cases where the water heater lacks a pilot light and instead relies upon an electronic ignition system, the controller may be adapted to regulate the ignition system.

The above summary of the present invention is not intended to describe each disclosed embodiment or every implementation of the present invention. The Figures, Detailed Description and Examples which follow more particularly exemplify these embodiments.

BRIEF DESCRIPTION OF THE FIGURES

The invention may be more completely understood in consideration of the following detailed description of various embodiments of the invention in connection with the accompanying drawings, in which.

Figure 1:
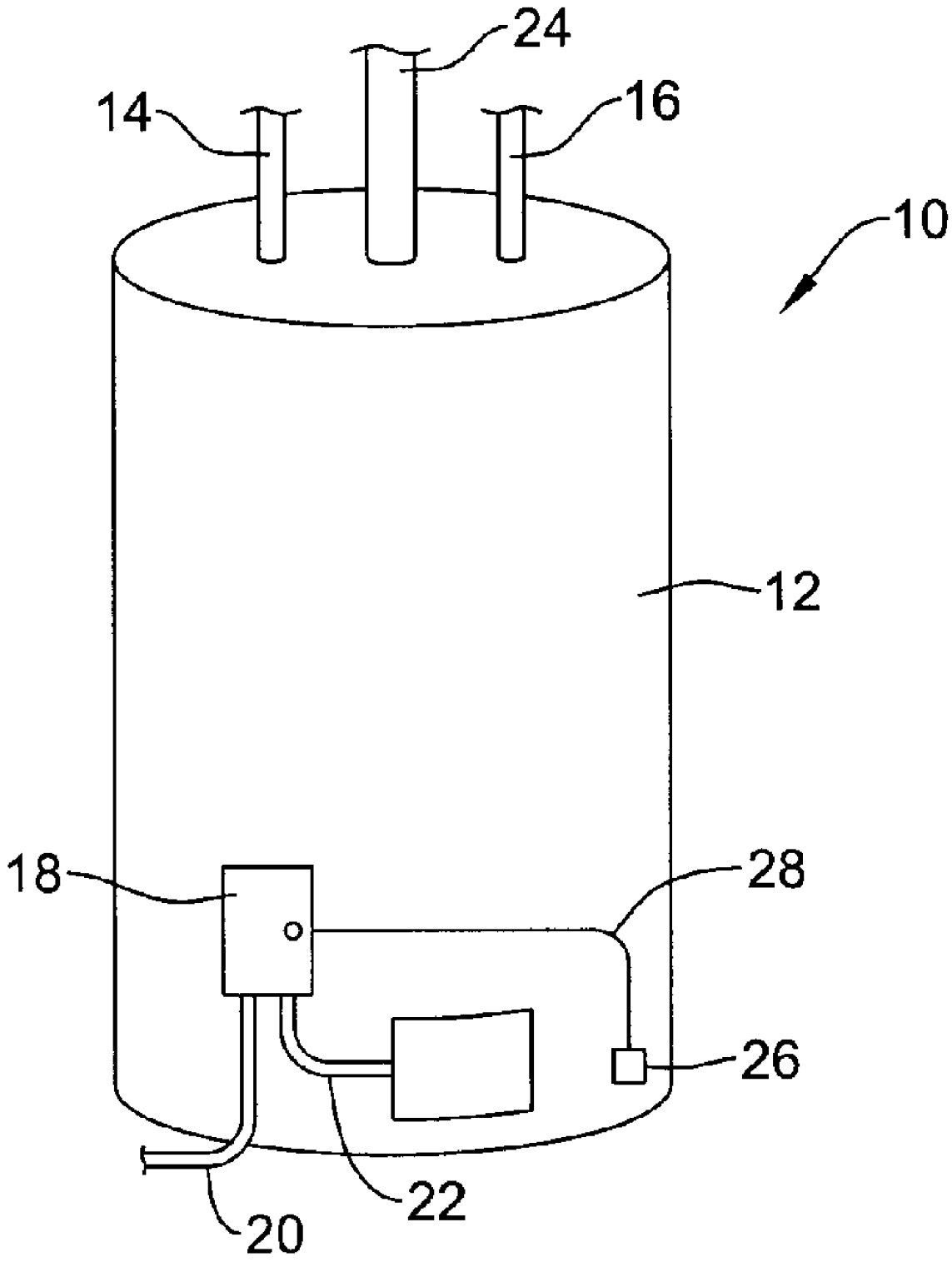
FIG. 1 is a view of a fuel-fired appliance in accordance with an illustrative embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

The following description should be read with reference to the drawings, in which like elements in different drawings are numbered in like fashion. The drawings, which are not necessarily to scale, depict selected embodiments and are not intended to limit the scope of the invention. Although examples of construction, dimensions, and materials may be illustrated for the various elements, those skilled in the art will recognize that many of the examples provided have suitable alternatives that may be utilized.

The present invention generally pertains to fuel-fired appliances that operate on fuels such as natural gas, propane, fuel oil and other combustible fuels. Exemplary fuel-fired appliances include appliances such as gas furnaces, gas water heaters, gas clothes dryers, gas fireplaces and the like. Merely for illustrative purposes, the present invention will be discussed with reference to a fuel-fired water heater, although it is to be understood that the invention is applicable to any fuel-fired appliance.

FIG. 1 illustrates a gas water heater 10. Water heater 10 includes a housing 12 that includes a water tank (not seen). Cold water enters the water tank through cold water line 14 and is heated by a gas burner. The resulting heated water exits through hot water line 16. A gas control unit 18 regulates gas flow from a gas source 20 through combustion gas line 22 and into the gas burner. A flue 24 permits combustion byproducts to safely exit.

As illustrated, water heater 10 also includes a vapor sensor 26 that, in the illustrative embodiment, is positioned exterior to housing 12 at a level that is at or below the unseen gas burner. However, in some embodiments, the vapor sensor 26 may be placed interior to the housing 12 and/or at or above the unseen gas burner, if desired. In some embodiments, vapor sensor 26 can be mounted integrally with gas control unit 18. In other embodiments, vapor sensor 26 can be mounted on the floor proximate water heater 10 or any other suitable location. Vapor sensor 26 communicates with gas control unit 18 through conduit 28. In some instances, water heater 10 may be mounted at an elevated position relative to a floor while vapor sensor 26 may be mounted at or near the floor.

Figure 2:
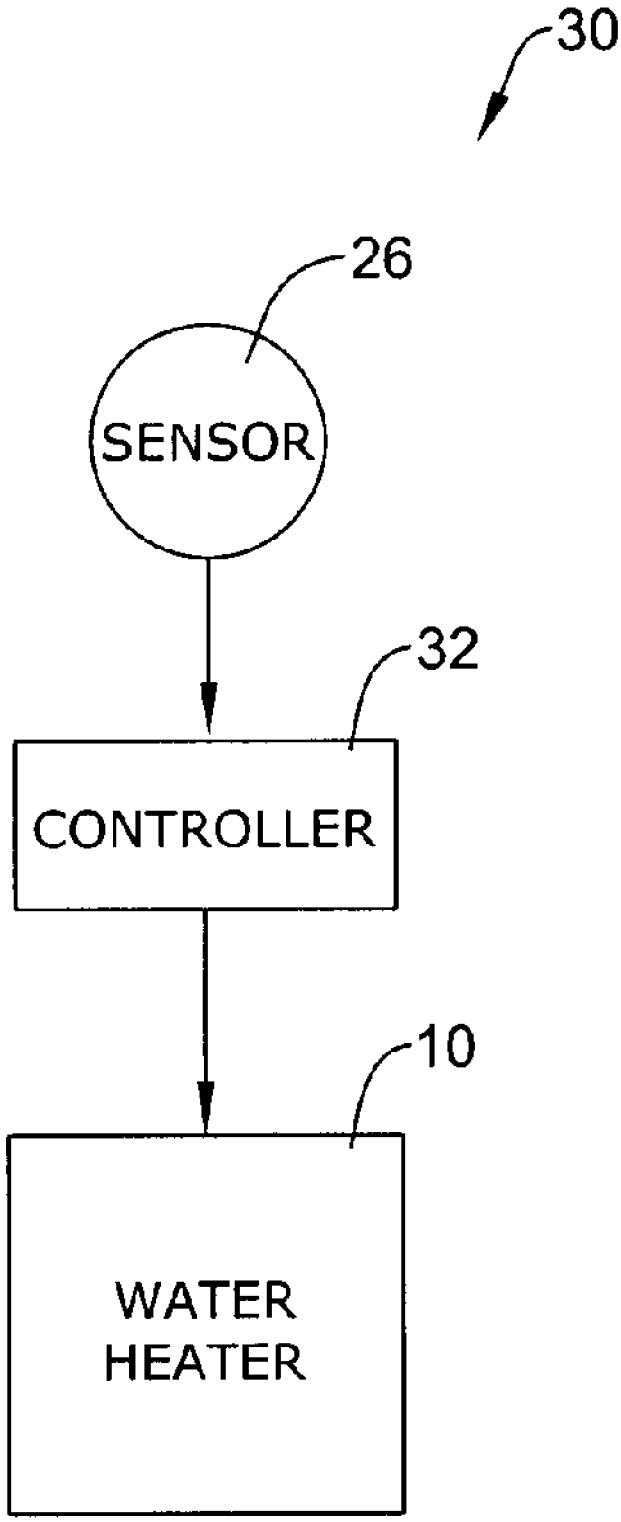
FIG. 2 is a schematic view of a controller system in accordance with an illustrative embodiment of the present invention.

FIG. 2 is a schematic diagram of an illustrative controller system 30. Controller system 30 can include software and/or hardware positioned within or proximate to gas control unit 18 (FIG. 1). In controller system 30, a controller 32 communicates with a vapor sensor 26 as well as a water heater 10, sometimes via gas control unit 18 (FIG. 1).

In operation, vapor sensor 26 provides a voltage, current, frequency or any other suitable signal that can be correlated to a concentration of detectable vapor that may exist in the environment immediately around vapor sensor 26. Vapor sensor 26 can be any suitable sensor adapted to detect vapor such as flammable vapor. In some cases, a safe level of a flammable vapor or a dangerous level of a flammable vapor can be set relative to the LFL (low flammability level) or the LEL (low explosive level) of the vapor in question. These values are well known for a large selection of common flammable vapors.

If the water heater 10 is installed in a garage, perhaps the LFL and/or LEL values for gasoline can be employed. If the water heater 10 is installed in a basement workshop, perhaps the LFL and/or LEL values for paint thinner can be used. In some instances, for example, if water heater 10 is installed in a utility room with other natural gas-fed appliances, the LFL and/or LEL values for natural gas can be used. In some cases, multiple sensors may be used, where each sensor is sensitive to a different vapor to be detected.

In some cases, controller system 30 can be programmed with the appropriate LFL and/or LEL values for a particular installation. In some embodiments, controller system 30 can be programmed or hardwired such that controller 32 ceases operation of water heater 10 when a detected level of flammable vapor reaches a threshold value, such as some fraction of the appropriate LFL or LEL value.

In one illustrative embodiment, the controller system 30 can be programmed with a first or relatively higher threshold value and a second or relatively lower threshold value. In some cases, the first or relatively higher value can be set equal to 50 percent of the LFL or the LEL of the vapor in question, while the second or relatively lower value can be set equal to 30 or perhaps 40 percent of the LFL or the LEL. In other cases, the first and second threshold values may be set to be the same value, if desired.

The operation of water heater 10 can enter the wait state when the vapor sensor detects a vapor concentration that is at or above the first or relatively higher threshold value. After a period of time, the water heater 10 may return to a run state if the vapor sensor detects a vapor concentration that is below the second or relatively lower value, or may enter a lockout state if the vapor sensor detects a vapor concentration that is still above the second or relatively lower value.

Figure 3:
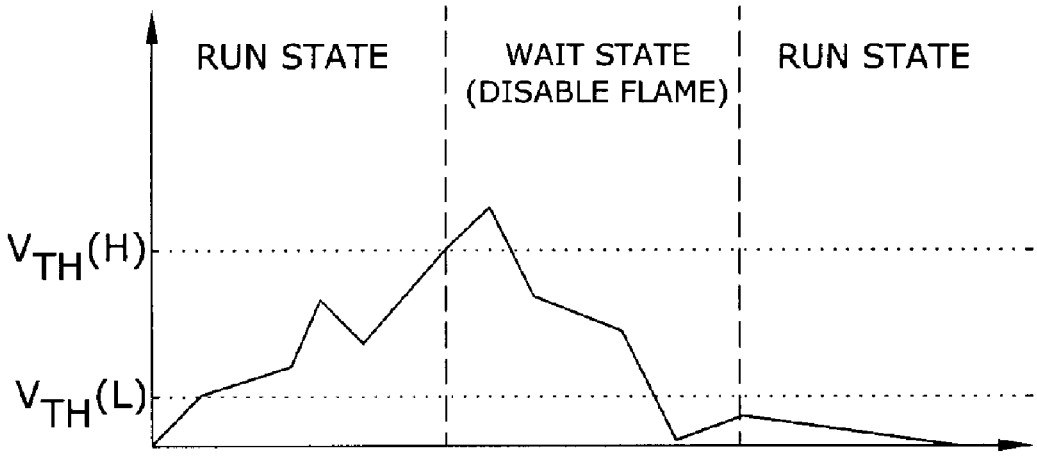
FIG. 3 is a diagrammatic illustration of an example scenario applicable to operation of the controller system of FIG. 2.
Figure 4:
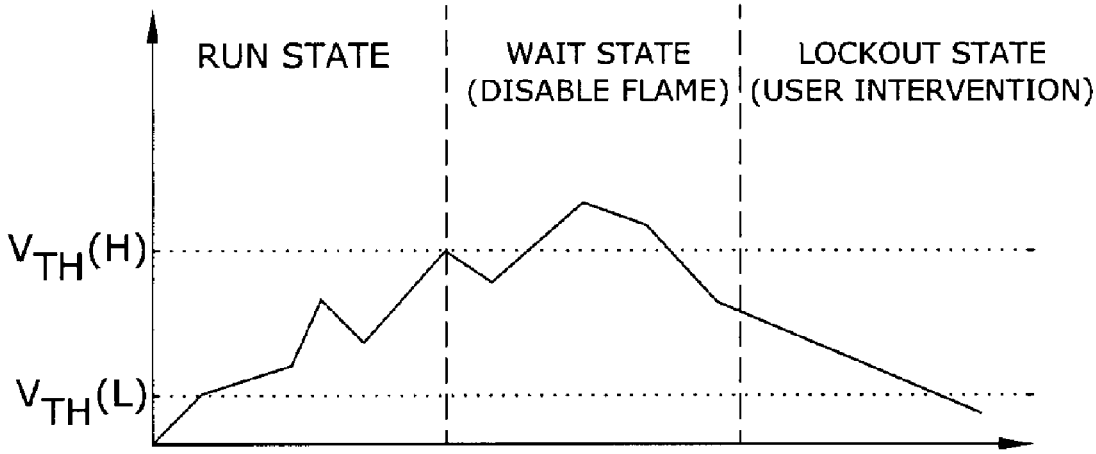
FIG. 4 is a diagrammatic illustration of an example scenario applicable to operation of the controller system of FIG. 2.
Figure 5:
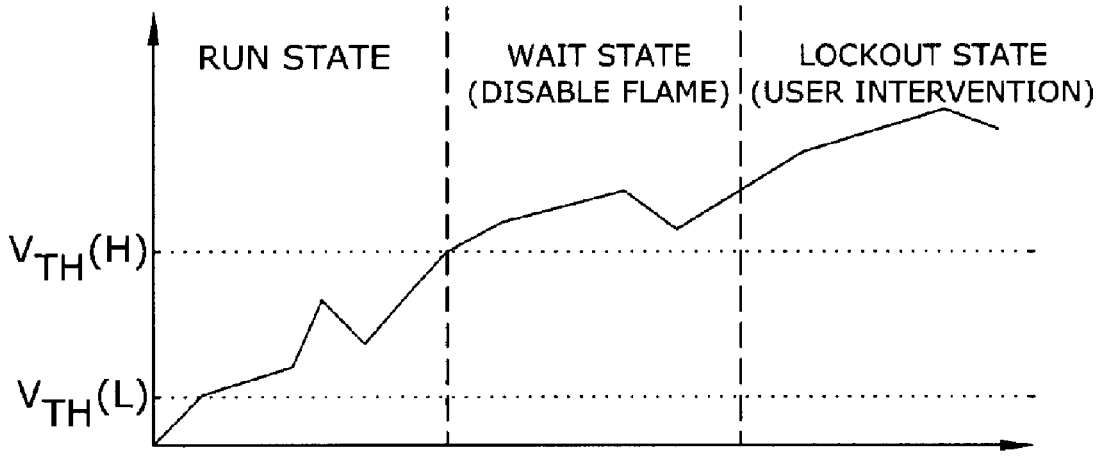
FIG. 5 is a diagrammatic illustration of an example scenario applicable to operation of the controller system of FIG. 2.

FIGS. 3, 4, and 5 represent various illustrative scenarios that can be encountered by controller system 30. In FIG. 3, water heater 10 begins in a run state in which the detected flammable vapor concentration remains at a safe level (e.g. below the first or relatively higher threshold value). In the illustrated scenario, the flammable vapor concentration begins at essentially zero and intermittently climbs. As long as the detected concentration remains below the first or higher predetermined value (indicated as $V_{TH}$(H) on the plot), water heater 10 remains in the run state.

At a certain point in time, the detected flammable vapor concentration reaches $V_{TH}$(H) and water heater 10 enters a wait state in which the burner is shut off. In some instances, controller 32 can instruct gas control unit 18 (FIG. 1) to also shut off fuel flow to a pilot light (if water heater 10 is so equipped) or controller 32 can instruct an ignition system (if water heater 10 is so equipped) to remain off. In the illustrative embodiment, the wait state lasts for a predetermined period of time, such as thirty seconds, one minute, five minutes, ten minutes, thirty minutes or any other suitable time period.

In the illustrated scenario, the detected flammable vapor concentration peaks and then tapers off. Water heater 10 remains in the wait state until the wait state expires. If, at the end of the wait state, the detected flammable vapor concentration has dropped below the second value, indicated on the plot as $V_{TH}$(L), the controller 32 can reenter the run state and instruct the gas control unit 18 (FIG. 1) to flow fuel to the pilot light and/or permit the ignition system to return to operation. Fuel flow to the burner may also be permitted.

FIG. 4 illustrates a scenario in which water heater 10 begins in a run state, much like in FIG. 3. During the wait state, however, the detected flammable vapor concentration drops after peaking but remains above the lower vapor level $V_{TH}$(L). In this instance, and at the end of the wait state, the water heater 10 enters a lockout state. In the lockout state, water heater 10 is prevented from operating. In some embodiments, user intervention is required in order to exit the lockout state.

FIG. 5 illustrates a scenario in which water heater 10 begins in a run state, much like in FIGS. 3 and 4. During the wait state, however, the detected flammable vapor concentration never peaks but instead continues to increase. Again, at the end of the wait state, the water heater 10 enters the lockout state, where the operation of the water heater 10 is prevented.

Figure 6:
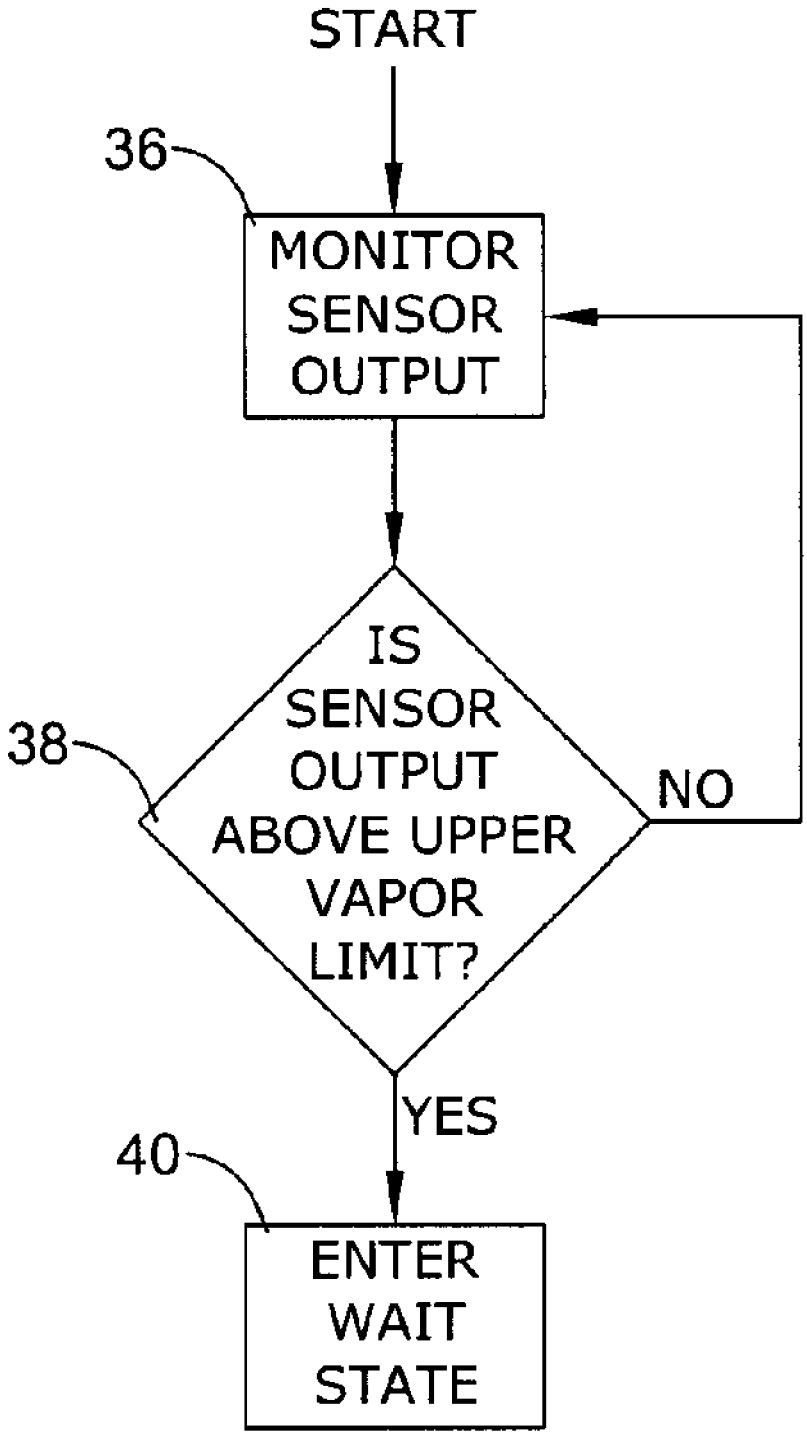
FIG. 6 is a flow diagram showing an illustrative method that may be implemented by the controller system of FIG. 2.
Figure 7:
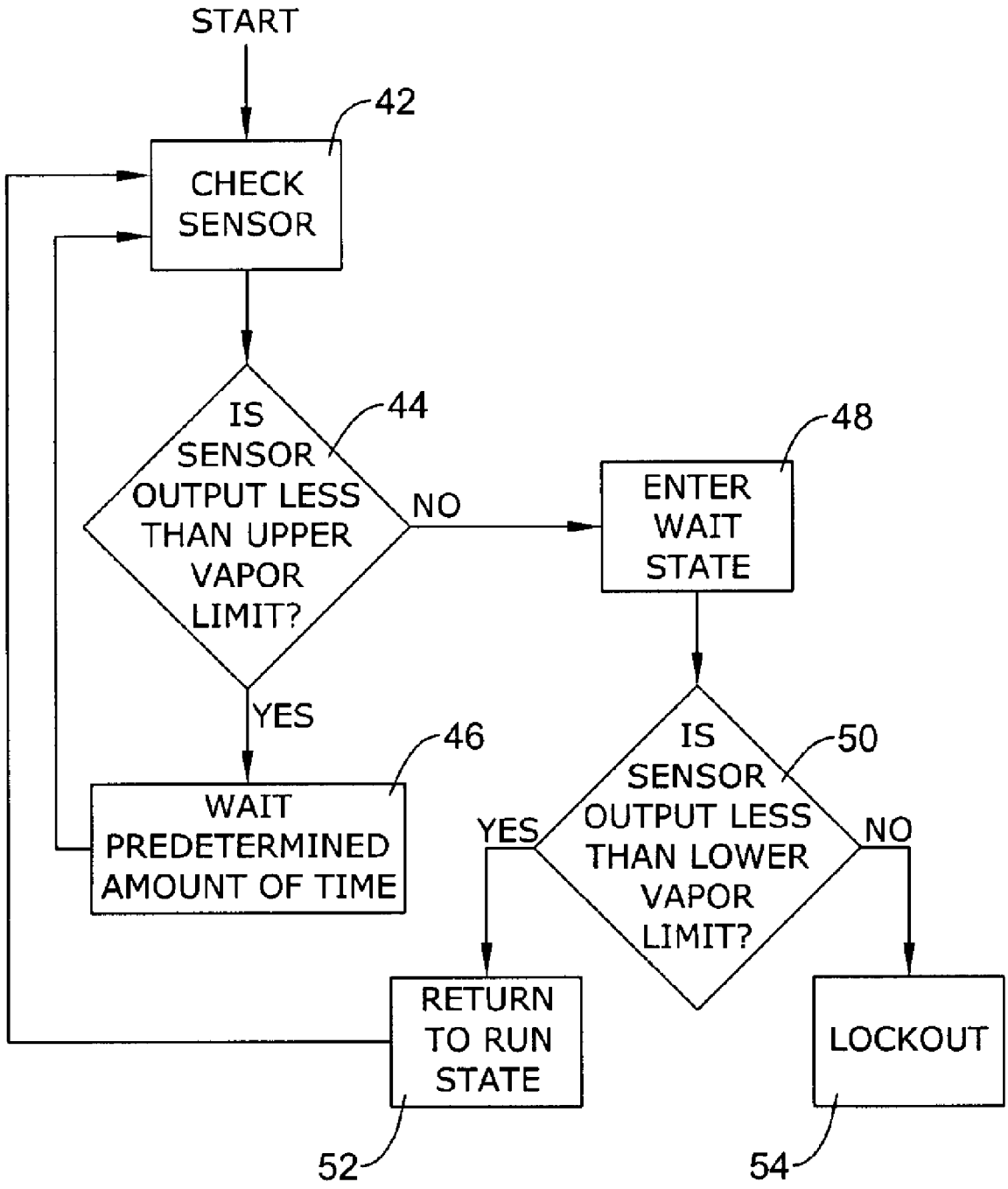
FIG. 7 is a flow diagram showing an illustrative method that may be implemented by the controller system of FIG. 2.

FIGS. 6 and 7 are flow diagrams showing illustrative methods that can be carried out by controller system 30 (FIG. 2). In FIG. 6, control begins at block 36, where system controller 30 monitors the output of vapor sensor 26 (FIG. 1). At decision block 38, system controller 30 ascertains whether or not the sensor output from vapor sensor 26 is above a first or upper vapor limit. If the sensor output from vapor sensor 26 is above the first or upper vapor limit, control passes to block 40 where water heater 10 enters a wait state and water heater operation ceases. If the sensor output from vapor sensor 26 is not above the first or upper vapor limit, control returns to block 36 where monitoring of the vapor sensor 26 continues.

FIG. 7 illustrates a method in which control begins at block 42. At block 42, controller system 30 (FIG. 2) checks vapor sensor 26 (FIG. 1). At decision block 44, controller system 30 determines if the sensor output from vapor sensor 26 is below a first or upper vapor limit. If so, control passes to block 46 at which point controller system 30 waits a predetermined amount of time before returning control to block 42. The predetermined amount of time can be any suitable amount of time and can represent a delay between successive checks of vapor sensor 26. For example, the predetermined amount of time can be one minute, thirty seconds, ten seconds, five seconds, one second or the like.

If the sensor output from vapor sensor 26 (FIG. 1) is above a first or upper vapor limit, control passes to block 48 at which point controller system 30 instructs water heater 10 to enter the wait state. In some embodiments, entering the wait state can encompass ceasing burner operation. At an end of the wait state, control passes to block 50 where controller system 30 ascertains if the sensor output from vapor sensor 26 is below a second or lower vapor limit. If so, control passes to block 52 and water heater 10 returns to the run state. Control then reverts back to block 42. If not, control passes to block 54 and water heater 10 enters a lockout state.

Figure 8:
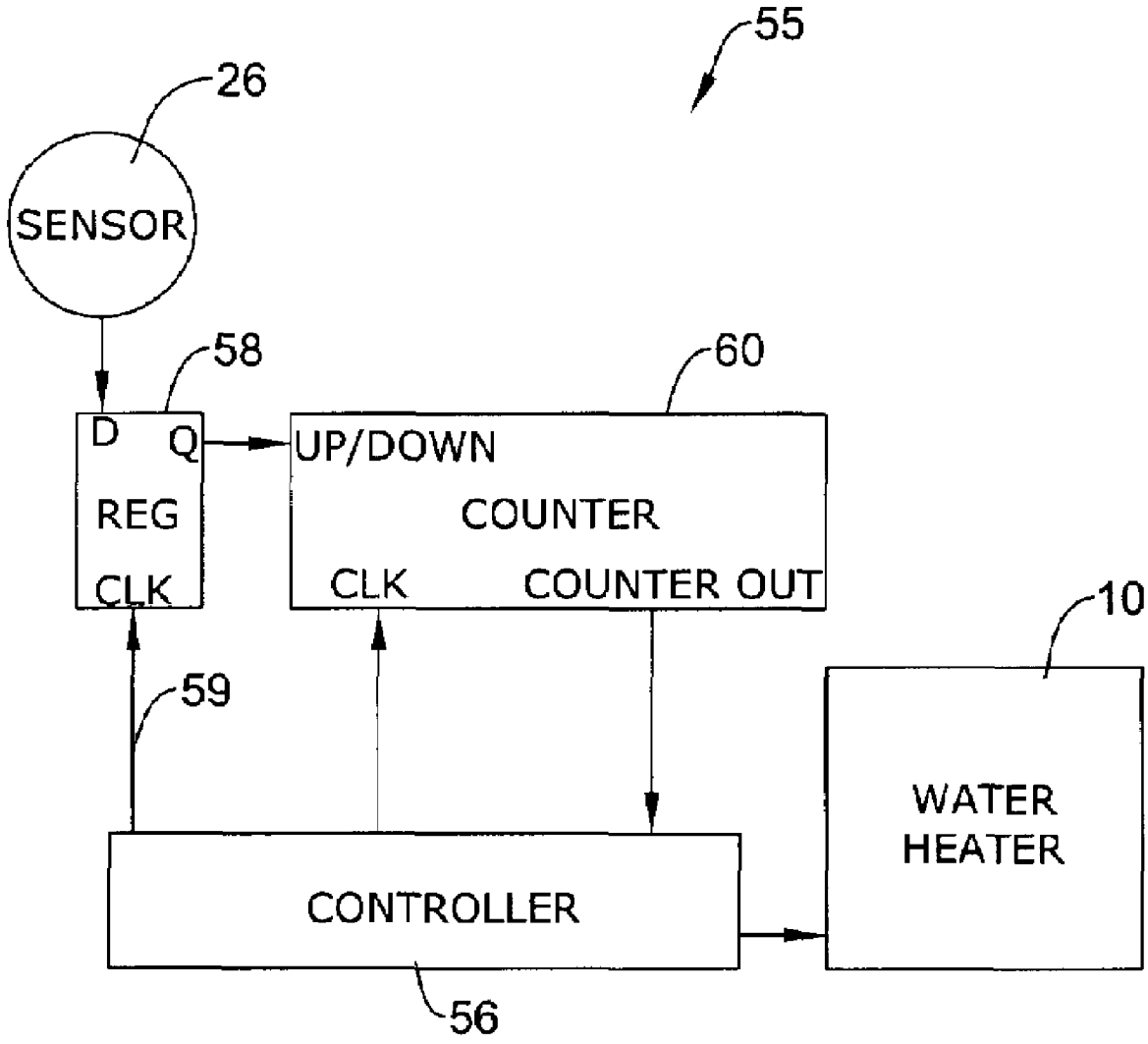
FIG. 8 is a schematic view of a controller system in accordance with another illustrative embodiment of the present invention.

FIG. 8 is a schematic diagram of an illustrative controller system 55. Controller system 55 can include software and/or hardware positioned within or proximate to gas control unit 18 (FIG. 1). In controller system 55, a controller 56 communicates with a register 58, an up-down counter 60 and a water heater 10. Register 58 communicates with vapor sensor 26, as well as the up-down control input of up-down counter 60.

In operation, vapor sensor 26 provides a voltage or other similar signal that can be correlated to a concentration of detectable vapor to register 58. The register clocks in a new concentration value each time controller 56 provides a clock pulse on clock line 59. In the embodiment shown, the new concentration value is a digital value, where a logic one represents the presence of an unsafe vapor concentration and a logic zero represents a safe vapor concentration. In some cases, an interface (not explicitly shown) may be provided between the vapor sensor 26 and the register 58 to adjust the threshold as to what is considered a safe or unsafe vapor concentration value. When so provided, this threshold level may be adjusted, depending on various factors including what state the controller 56 is currently in (e.g. run, wait, lockout, etc.)

The up/down counter 60 may include provisions such as circuitry or software that can increment or decrement a stored counter value depending on the state of the up/down control signal, which is provided by register 58. For example, if the register 58 provides a logic one (indicating that the vapor sensor 26 has detected an actionable level of flammable vapor), up/down counter 60 can increment the stored counter value. Likewise, if register 58 provides a logic zero (indicating that the vapor sensor 26 has not detected or is no longer detecting an actionable level of flammable vapor), up/down counter 60 can decrement the stored counter value. Use of such a counter value will be discussed in greater detail with respect to FIGS. 12 and 13 below.

Figure 9:
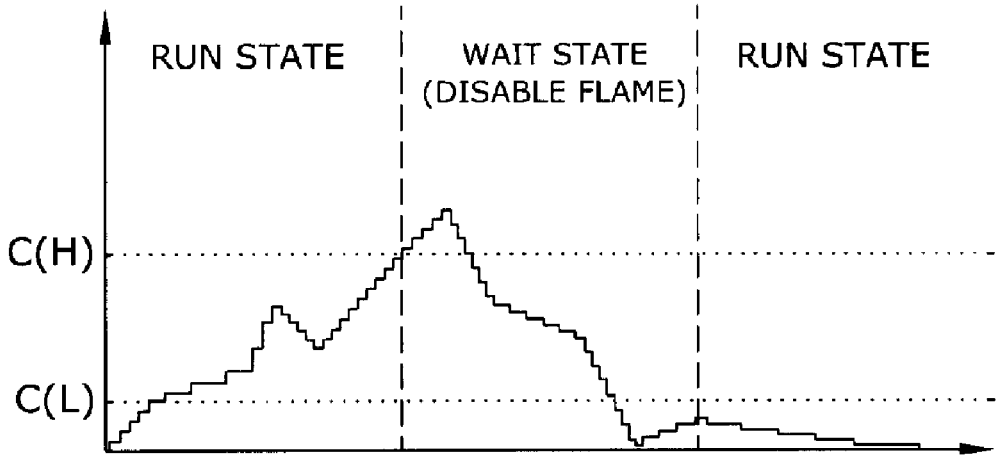
FIG. 9 is a diagrammatic illustration of an example scenario applicable to operation of the illustrative controller system of FIG. 8.
Figure 10:
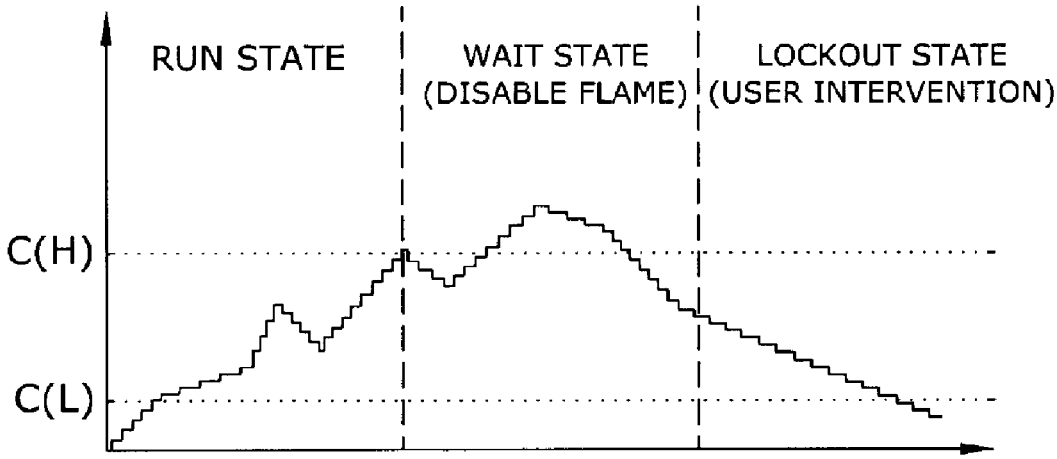
FIG. 10 is a diagrammatic illustration of an example scenario applicable to operation of the illustrative controller system of FIG. 8.
Figure 11:
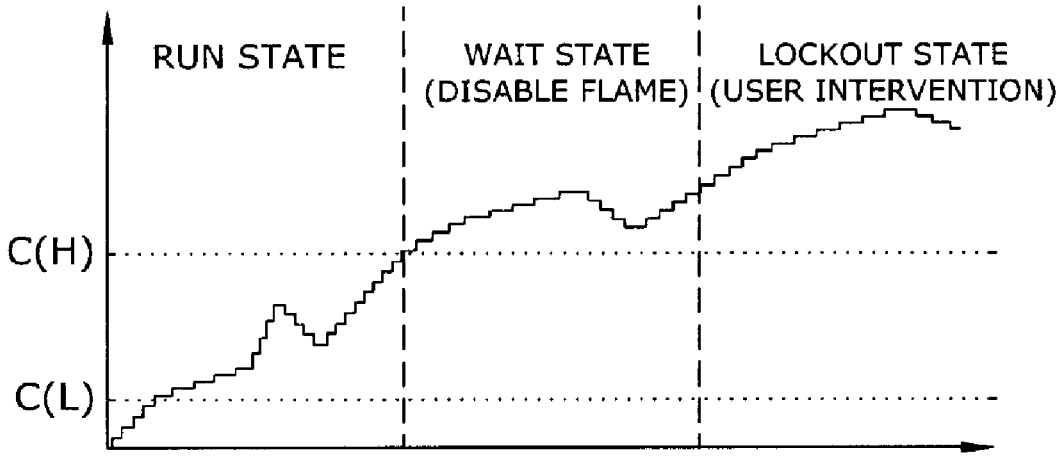
FIG. 11 is a diagrammatic illustration of an example scenario applicable to operation of the illustrative controller system of FIG. 8.

FIGS. 9, 10, and 11 represent various illustrative scenarios that can be encountered by illustrative controller system 55. In FIG. 9, water heater 10 begins in a run state in which the counter value that provides a representation of the detected flammable vapor concentration remains below a first or higher threshold value for a period of time. In the illustrated scenario, the counter value begins at zero and intermittently is incremented in step-wise fashion. As long as the counter value remains below a first or higher predetermined counter threshold value (indicated as $C_{TH}$(H) on the plot), water heater 10 remains in the run state.

The counter value can represent a number of sensor readings indicating the presence of flammable vapors minus a number of sensor readings indicating an absence of flammable vapors. In other instances, the counter value can be proportional to the concentration of detected flammable vapors. In some instances, controller system 55 (FIG. 8) can be programmed to ignore transitory spikes in the signal from vapor sensor 26, resulting in the counter value remaining at a given level for a longer period of time.

At a certain point in time, the counter value reaches $C_{TH}$(H), and water heater 10 enters a wait state in which the burner is shut off. In some instances, controller 56 can instruct gas control unit 18 (FIG. 1) to also shut off fuel flow to a pilot light (if water heater 10 is so equipped) or controller 56 can instruct an ignition system (if water heater 10 is so equipped) to remain off.

In the illustrated scenario, the counter value peaks and then tapers off. However, water heater 10 remains in the wait state until the wait state expires. After the wait state expires, and in the illustrative scenario, the counter value has decremented below a second or lower threshold value, indicated on the plot as $C_{TH}$(L). As such, controller 56 instructs gas control unit 18 (FIG. 1) to flow fuel to the pilot light or permit the ignition system to return to operation. Fuel flow to the burner is also be permitted.

FIG. 10 illustrates a scenario in which water heater 10 begins in a run state, much like in FIG. 3. During the wait state, however, the counter value decrements after peaking but remains above the second or lower vapor threshold level $C_{TH}$(L). In this instance, the wait state ends by water heater 10 moving into the lockout state. In the lockout state, water heater 10 is prevented from operating. In some embodiments, user intervention is required in order to exit the lockout state.

FIG. 11 illustrates a scenario in which water heater 10 begins in a run state, much like in FIGS. 9 and 10. During the wait state, however, the counter value never peaks but instead continues to increase. Again, because the counter value has not been decremented below the second or lower threshold value $C_{TH}$(L) by the end of the wait state, the water heater 10 enters the lockout state.

Figure 12:
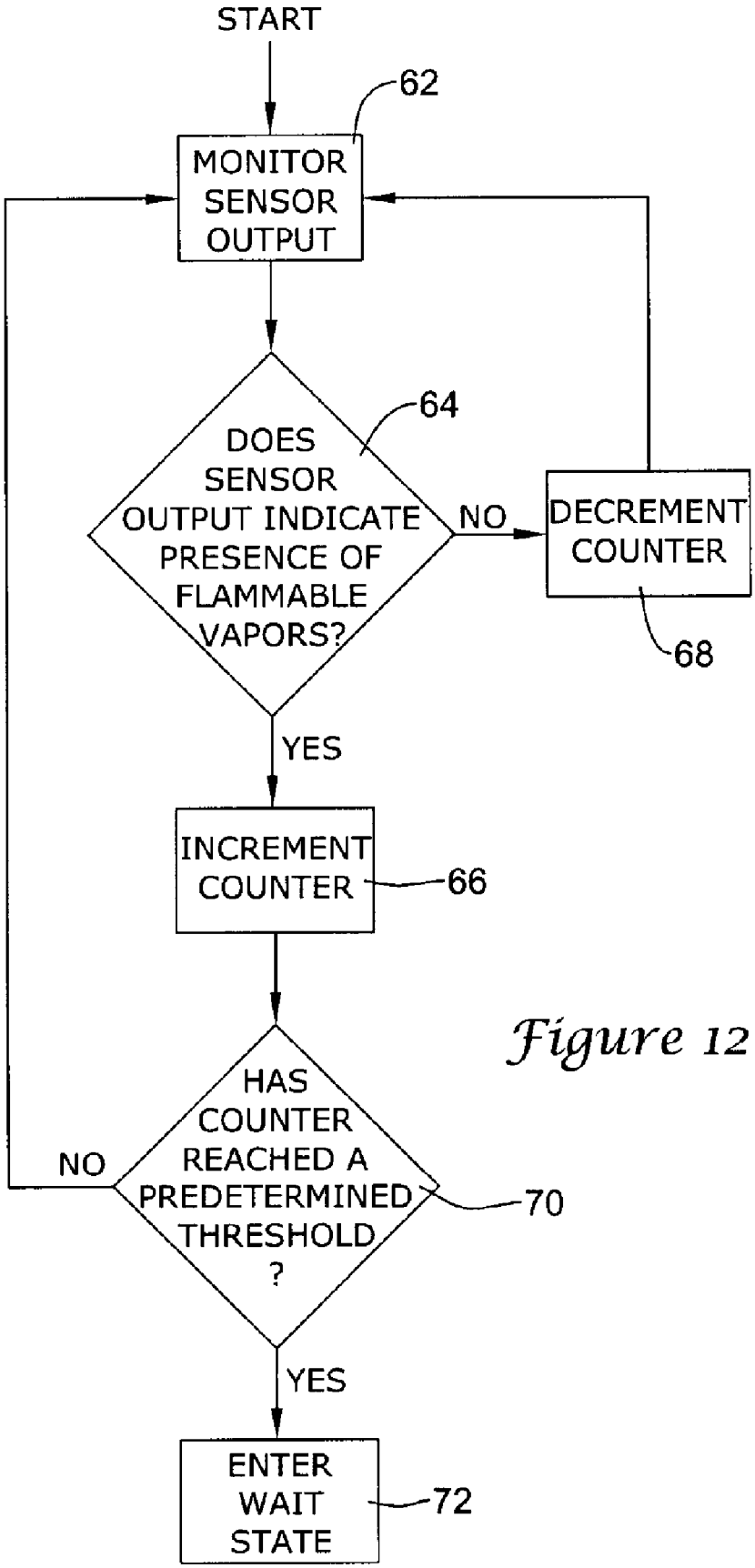
FIG. 12 is a flow diagram showing an illustrative method that may be implemented by the illustrative controller system of FIG. 8.
Figure 13:
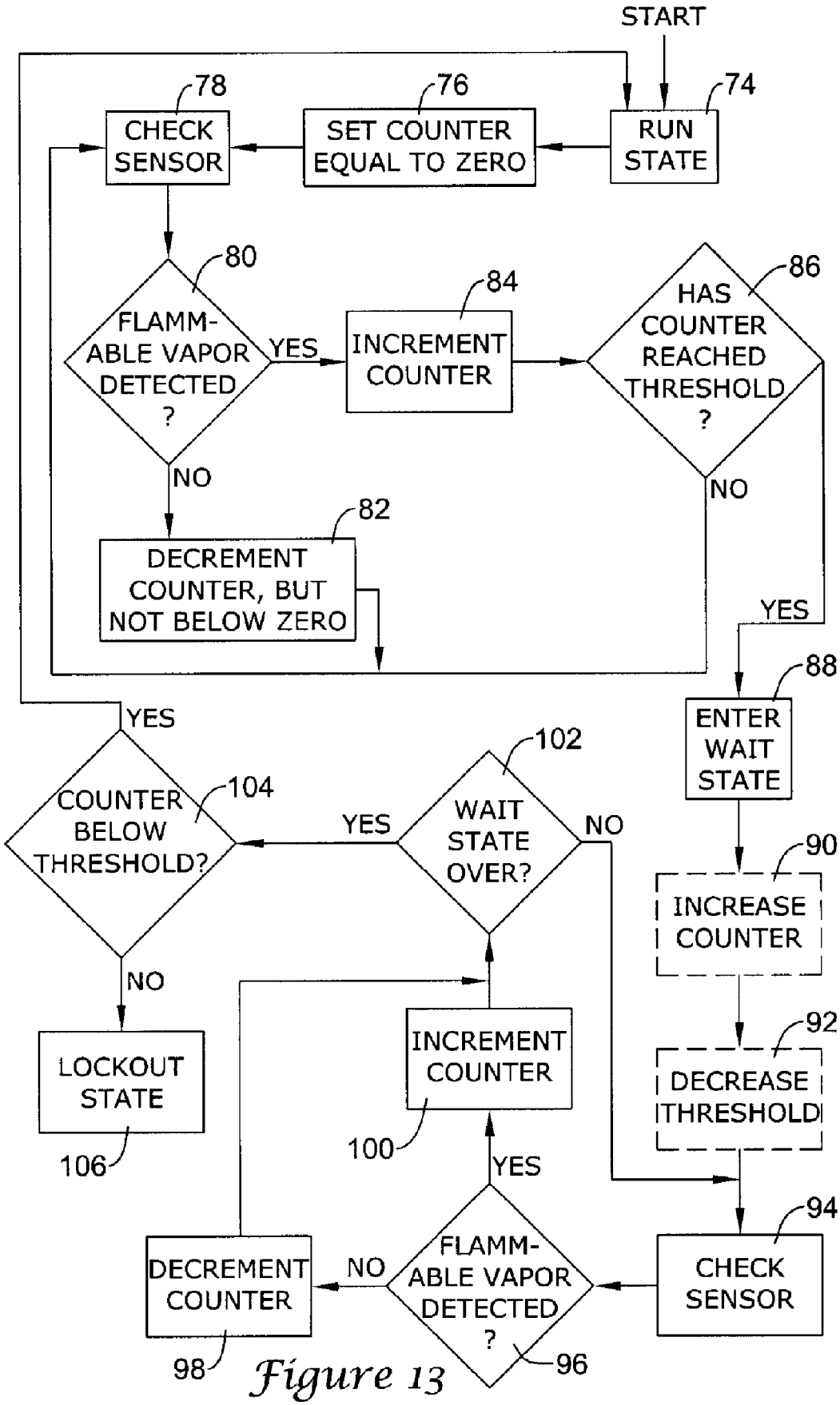
FIG. 13 is a flow diagram showing an illustrative method that may be implemented by the illustrative controller system of FIG. 8.

FIGS. 12 and 13 are flow diagrams showing illustrative methods that can be carried out by illustrative controller system 55 (FIG. 8). FIG. 12 illustrates a method in which control begins at block 62. At block 62, controller system 55 (FIG. 8) monitors the sensor output from vapor sensor 26 (FIG. 1). Control passes to decision block 64, where controller system 55 determines if the sensor output from vapor sensor 26 indicates the presence of flammable vapor. If the sensor output from vapor sensor 26 does not indicate the presence of flammable vapor, control passes to block 68 where controller system 55 decrements the counter, followed by control reverting back to block 62. In the illustrative embodiment, the counter is not decremented below a counter value of zero.

If the sensor output from vapor sensor 26 (FIG. 1) does indicate the presence of flammable vapors, control passes to block 66 where controller system 55 increments the counter. Control then passes to block 70, where controller system 55 determines if the counter has reached a predetermined threshold value. If not, control reverts back to block 62. If the counter has reached the predetermined threshold value, control passes to block 72 at which point water heater 10 enters the wait state.

FIG. 13 illustrates a method in which control begins at block 74. At block 74, water heater 10 is in the run state. A counter is set to zero at block 76, and control then passes to block 78 where controller system 55 (FIG. 8) checks vapor sensor 26 (FIG. 1). At decision block 80, controller system 55 determines if vapor sensor 26 is indicating an actionable or potentially dangerous level of flammable vapor. If not, control passes to block 82, where controller system 55 decrements the counter. In some cases, the counter may be decremented by one. In other instances, however, the counter may be decremented by two, three or any other suitable integer, as desired. It should be noted, however, that in the illustrative embodiment, the counter is not permitted to decrement to a value that is less than zero. Control then reverts back to block 74.

If the vapor sensor 26 is indicating the presence of flammable vapors, control passes to block 84 and the counter is incremented. In some instances, the counter is incremented by one. In other cases, the counter may be incremented by two, three or any other suitable integer, as desired.

In some embodiments, the relative speed at which water heater 10 enters or leaves the wait state can be influenced by incrementing and decrementing the counter by different amounts. For example, if the counter is incremented by two each time flammable vapor is detected, but is only decremented by one each time flammable vapor is not detected, then the water heater 10 may enter the wait state relatively fast. Also, more readings indicating that a flammable vapor is not present may be required to return to the run state.

At decision block 86, controller system 55 determines if the counter has reached a threshold. If not, control reverts back to block 86. If the counter has reached the threshold, control passes to block 88 at which point controller system 55 (FIG. 8) enters the wait state. In some instances, the counter can then be optionally incremented multiple times in order to set a minimum duration for the wait state. This is illustrated at optional block 90.

In some instances, the counter threshold for leaving the wait state and returning to the run state can be reduced. This is illustrated at optional block 92. In some instances, the original counter threshold can correspond to the first or relatively higher vapor threshold while the reduced counter threshold can correspond to the second or relatively lower vapor threshold.

Control passes to block 94, where controller system 55 (FIG. 8) checks vapor sensor 26 (FIG. 1). At decision block 96, controller system 55 determines whether or not vapor sensor 26 is indicating the presence of flammable vapor. If not, control passes to block 98 and the counter is decremented, followed by passing control to decision block 102. If vapor sensor 26 is indicating the presence of flammable vapor, control passes to block 100 where the counter is incremented, followed by control passing to decision block 102.

At decision block 102, controller system 55 (FIG. 8) determines if the wait state has lasted sufficiently long. If the wait period is not over, control reverts back to block 94. If the wait period is over, control passes to decision block 104. At decision block 104, controller system 55 (FIG. 8) determines if the counter value is below the threshold. In some instances, the threshold can represent a reduced threshold as discussed above. If the counter has dropped below the threshold, control reverts back to block 74 and water heater 10 returns to the run state. If, however, the counter has not dropped below the threshold, control passes to block 106 at which point water heater 10 enters the lockout state.

The invention should not be considered limited to the particular examples described above, but rather should be understood to cover all aspects of the invention as set out in the attached claims. Various modifications, equivalent processes, as well as numerous structures to which the invention can be applicable will be readily apparent to those of skill in the art upon review of the instant specification

What is claimed is:

1. A method of controlling an appliance, the appliance comprising a burner and a sensor that can detect flammable vapors exterior to the burner, the method comprising steps of:

monitoring an output of the sensor;

decrementing a counter when the sensor output indicates a presence of flammable vapors above a first predetermined level; and incrementing the counter when the sensor output indicates the level of flammable vapors below a second predetermined level, wherein the second predetermined level is different from the first predetermined level; and stopping burner operation if the counter value falls below a first predetermined value.

2. A method of controlling a fuel-fired appliance, the appliance comprising a burner and a sensor that can detect flammable vapors exterior to the burner, the method comprising steps of:

monitoring an output of the sensor;

preventing the burner from operating for a fixed period of time if the output of the sensor is above an upper vapor limit; and restarting the burner if, at the end of the fixed period of time, the sensor output is below a lower vapor limit, wherein the lower vapor limit is below the upper vapor limit.

3. The method of claim 2, wherein, prior to preventing the burner from operating for the fixed period of time, the burner is permitted to run as long as the sensor output is below the upper vapor limit.

4. The method of claim 2, wherein during the fixed period of time the sensor output is at least periodically monitored.

5. The method of claim 2, wherein if at the end of the fixed period of time the sensor output is above a lower vapor limit, the appliance enters a lockout state, wherein in the lockout state, burner operation is prevented without some user intervention.

6. A fuel-fired water heater, comprising:

a burner;

a sensor adapted to detect flammable vapors exterior to the burner; and a controller that is configured to:

monitor an output of the sensor;

stop operation of the burner if the sensor output indicates a sufficient presence of flammable vapors, and after a fixed period of time of stopped operation, automatically restart the burner if the sensor output indicates an insufficient presence of flammable vapors; and lockout the burner if the sensor output indicates a sufficient presence of flammable vapors after the fixed period of time.

7. The fuel-fired water heater of claim 6, wherein the controller is adapted to regulate gas flow to the burner.

8. The fuel-fired water heater of claim 6, wherein the fuel-fired water heater further comprises a pilot light, and the controller is adapted to regulate gas flow to the pilot light.

9. The fuel-fired water heater of claim 6, wherein the fuel-fired water heater further comprises an ignition system, and the controller is adapted to regulate the ignition system.

10. A method of controlling an appliance, the appliance comprising a burner, an ignition system, and a sensor that can detect flammable vapors exterior to the burner, the method comprising steps of:

detecting flammable vapors;

disabling the burner if flammable vapors are detected above a first predetermined level;

if the disabling step disables the burner, waiting a time period;

sometime after the time period, determining if flammable vapors are detected below a second predetermined level, wherein the second predetermined level is different from the first predetermined level;

entering a run state if flammable vapors are detected below the second predetermined level, wherein in the run state, the burner is no longer disabled; and entering a lockout state if flammable vapors are detected above the second predetermined level, wherein in the lockout state, burner operation is prevented without some user intervention; and wherein during the entering a run state step, the ignition system enters a run state if flammable vapors are detected below the second predetermined level, and during the entering a lockout state, the ignition systems enters a lockout state if flammable vapors are detected above the second predetermined level.

11. The method of claim 10 wherein the first predetermined level is higher than the second predetermined level.

12. The method of claim 10 wherein the first predetermined level is lower than the second predetermined level.

13. The method of claim 10, wherein during the waiting step, the burner is disabled.

14. The method of claim 10, wherein in the run state the burner is permitted to operate.

15. The method of claim 10, wherein the time period is greater than thirty seconds.

16. The method of claim 10, wherein the first predetermined level is set to correspond to a vapor concentration that is a percentage of the flammability level for the flammable vapors.

17. The method of claim 10, wherein the first predetermined level is set to correspond to a vapor concentration that is a percentage of the explosive level for the flammable vapors.

18. A method of controlling an appliance, the appliance comprising a burner and a sensor that can detect flammable vapors exterior to the burner, the method comprising steps of:

monitoring an output of the sensor;

incrementing a counter having a counter value when the sensor output indicates a presence of flammable vapors above a first predetermined level;

decrementing the counter when the sensor output indicates a level of flammable vapors that is below a second predetermined level, but not allowing the counter value to fall below a selected lower counter limit, wherein the second predetermined level is below the first predetermined level; and stopping burner operation if the counter value reaches a first predetermined value.

19. The method of claim 18, wherein the selected lower counter limit is zero.

20. The method of claim 18, wherein the stopping burner operation step includes initiating a wait state in a controller of the appliance, wherein in the wait state, the controller stops the burner operation.

21. The method of claim 20, wherein initiating the wait state includes the step of further incrementing the counter.

22. The method of claim 20, wherein the wait state further comprises the steps of:

monitoring the output of the sensor;

incrementing the counter when the sensor output indicates a presence of flammable vapors above a third predetermined level; and decrementing the counter when the sensor output indicates a level of flammable vapors below a fourth predetermined level.

23. The method of claim 22, further comprising the step of initiating a lockout state in the controller of the appliance if the counter value is above a second predetermined value at the end of the wait state, wherein in the lockout state, the controller does not permit burner operation without user intervention.

24. The method of claim 22, further comprising a step of entering a run state in the controller of the appliance if the counter value is below the second predetermined value at the end of the wait state, wherein in the run state, the controller permits the burner to operate.

* * * * *

UNITED STATES PATENT AND TRADEMARK OFFICE

CERTIFICATE OF CORRECTION

PATENT NO. : 7,604,478 B2
APPLICATION NO. : 10/907117
DATED : October 20, 2009
INVENTOR(S) : Anderson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 427 days.

Signed and Sealed this

Fifth Day of October, 2010

David J. Kappos

David J. Kappos
*Director of the United States Patent and Trademark Office*